US005165316A

United States Patent [19]

Hayes

[11] Patent Number: 5,165,316

[45] Date of Patent: Nov. 24, 1992

[54] CHAIN MERCHANDISING APPARATUS

[75] Inventor: Richard D. Hayes, Edwardsville, Ill.

[73] Assignee: LaClede Chain Manufacturing Company, St. Louis, Mo.

[21] Appl. No.: 723,931

[22] Filed: Jul. 1, 1991

[51] Int. Cl.[5] ..... B26D 1/00

[52] U.S. Cl. ..... 83/522.17; 83/650; 83/949; 211/59.200; 242/132; 242/139; 283/39; 283/114

[58] Field of Search ..... 83/650, 949, 950, 649, 83/522.21, 522.17, 646; 242/132, 137, 139, 146, 55.3, 55.42; 225/36, 34; 221/307, 310, 92; 108/50; 312/12, 107, 107.5, 126, 216; 283/114, 39; 206/45; 211/59.2

[56] References Cited

U.S. PATENT DOCUMENTS

| | | | |
|---|---|---|---|
| D. 209,640 | 12/1967 | Platky et al. . | |
| D. 217,701 | 5/1970 | Schlueter . | |
| D. 244,412 | 5/1977 | Messenger . | |
| 1,070,611 | 8/1913 | Jones | 242/137 |
| 1,375,169 | 4/1921 | Parks | 225/36 |
| 1,390,969 | 9/1921 | Leet | 83/650 X |
| 1,560,058 | 11/1925 | Jamieson | 283/39 X |
| 1,840,297 | 1/1932 | Alexander | 206/45 |
| 1,938,815 | 12/1933 | Grenier | 221/92 |
| 4,119,208 | 10/1978 | Acker | 211/59.2 |
| 4,530,548 | 7/1985 | Spamer et al. | 211/59.2 X |
| 4,537,106 | 8/1985 | Rider | 83/650 |
| 4,763,796 | 8/1988 | Flum | 108/111 X |
| 5,050,734 | 9/1991 | Chen | 312/12 X |

*Primary Examiner*—Douglas D. Watts
*Assistant Examiner*—Kenneth E. Peterson
*Attorney, Agent, or Firm*—Kalish & Gilster

[57] ABSTRACT

A chain merchandising apparatus includes a frame, a cabinet secured to the frame, and chain support means mounted to the frame and located within the cabinet for supporting a plurality of chain containers. A chain cutter is moveably fixed to the apparatus so as to be selectivity adjustable vertically and horizontally in relation thereto for permitting a user to position the chain cutter substantially adjacent to a preselected chain container supported on the chain support means.

24 Claims, 4 Drawing Sheets

CHAIN MERCHANDISING APPARATUS

BACKGROUND OF THE INVENTION

1. Field of Invention

This invention relates, in general, to the field of chain merchandising apparatuses and, more particularly, to an apparatus for merchandising chain which is provided with multiple adjustable shelves for receiving chain containers and further, having a selectively adjustable cutting mechanism attached thereto.

2. Description of the Prior Art

Consumers encounter a wide variety of situations requiring or facilitated by the use of chains. A few examples of these include suspending a child's swing, leashing a pet, anchoring a water heater or towing a vehicle. Each use may require a different type or weight of chain. The particular length of chain desired by the purchaser also varies widely. Accordingly, it is necessary for hardware stores and the like to provide many types of chain, preferably in bulk, so that the purchaser may select the desired length and style.

However, a number of concerns arise for the retailer who merchandises chain. For example, chain is inherently bulky and heavy. Therefore, a great deal of floor space is usually required to accommodate a significant selection of chain types and any apparatus used to hold chain in the store must be quite sturdy. Moreover, some method must be made available for cutting the chain desired by the customer and, in particular, cutting it to a preselected length. If a self-service system is provided, the area where the chain is displayed often becomes untidy and potentially hazardous as consumers in making their purchasing decisions pull out, examine and leave uncut lengths of various rejected styles of chains which subsequently become tangled in a heap upon the floor. This creates a safety hazard in terms of trip and fall accidents, a major concern in retail establishments such as hardware stores.

Also, if the consumer is allowed to cut his or her own chain, some cutting mechanism therefore must necessarily be made available, preferably in such a manner that it does not present a hazard to small children who may be allowed to wander unattended throughout the store. The alternative is to require that all chain be cut by store personnel, resulting in increased costs and often either an extended wait or a lost customer. In either case, known chain merchandising apparatuses lack measuring means and thus cause some chain to be wasted as incorrect cuts are necessarily occasionally made.

Further, it is desirable that there be some integral accommodation for drawing attention to the in-store location of the display and for providing information such as, for example, the brand of chain and/or the particular size of or use for the individual chain styles offered.

Heretofore, various open-sided, coverless display stands or racks have been provided for merchandising chain. For example, U.S. Pat. No. 244,412 issued to Messenger illustrates a merchandise display rack which could be used for supporting spools of various sizes of chain. Messenger does not teach any type of measuring device or cutter or any means for preventing the merchandise displayed thereon from becoming dusty, tangled and generally untidy.

U.S. Pat. No. 209,640 to Platky et al and U.S. Pat. No. 217,701 to Schlueter each illustrate a combined display stand and cutter for chain or the like. In each case, the cutter is fixed at the floor level and the stand is open, somewhat flimsy and limited in use to providing spaces for only a few sizes or types of chain. Neither provides any method for covering the chain to prevent dust accumulation, nor is a significant amount of cabinet wall surface area available for providing information to the consumer.

Thus in the long history of chain merchandising very little has been done to update chain displays in the interest of safety, advertising, efficiency and overall appearance.

Accordingly, it is among the several objects of the present invention to provide an apparatus for merchandising chain in retail establishments so as to clearly and neatly display a varied selection of chain in a neat, safe manner using a minimal amount of floor space and reducing waste. It is intended that the apparatus be capable of holding various sizes of containers of chain and that such containers be supported on shelves which are easily filled, emptied and refilled.

It is further among the objects of the present invention that the apparatus having the above attributes also have an attached cutting mechanism which is facilely adjustable and capable of being used by the consumer to measure a desired amount of chain and to separate that length from the source container thereof.

It is also among the objects of the present invention having the above features that the apparatus provide a method to at least partially enclose the containers of chain displayed therein so as to keep them relatively free from dust and other debris and to provide a surface area for displaying advertising or other information regarding the chain contained therein. It is intended that the chain merchandising apparatus of the present invention be capable of being supplied to the retailer in a number of parts to facilitate shipping and storage and to enable the retailer to easily assemble the unit on site by use of only a few conventional hand tools, such as a screw driver and wrench.

Thus, in furtherance of the above objects, the present invention is, briefly, a chain merchandising apparatus including a frame, a cabinet secured to the frame, and chain support means connected to the frame and located within the cabinet for supporting a plurality chain containers. A chain cutter is moveably fixed to the apparatus so as to be selectively adjustable in relation thereto.

Also in keeping with the chain merchandising apparatus of the present invention, briefly, the cabinet is provided with an upper portion and a lower portion. The chain support means, the cabinet upper portion and the cabinet lower portion are detachably connected to the frame and the chain cutter is detachably moveably fixed to the apparatus such that the apparatus may be disassembled and reassembled to facilitate shipping by a manufacturer thereof to a chain retailer and to further facilitate subsequent reassembly by such chain retailer.

Further in keeping with the above objects, the present invention is, briefly, a chain merchandising apparatus for use in combination with substantially box-shaped containers of chain. The containers are of at least one preselected size and have a face portion and at least one tab provided on the container adja a lower edge of the face. The chain merchandising apparatus includes a frame, a cabinet connected to the frame, and chain support means connected to the frame and located within the cabinet for supporting a plurality of chain containers. The chain cutting means are moveably fixed to the apparatus so as to be selectively adjustable in relation thereto and the chain support means consist of at least one shelf, each shelf having an upper surface, a front edge and a back edge and being provided with grooves in the upper surface thereof, the grooves extending substantially from the front edge to the back edge, and being spaced parallel to each other at a preselected distance so as to be adapted for receipt of the tabs provided on the substantially box-shaped chain containers, to thereby facilitate proper placement and movement of the chain containers on the shelves.

Other objects will be in part apparent and in part pointed hereinbelow.

DESCRIPTION OF THE PREFERRED EMBODIMENT OF THE INVENTION

Figure 1:
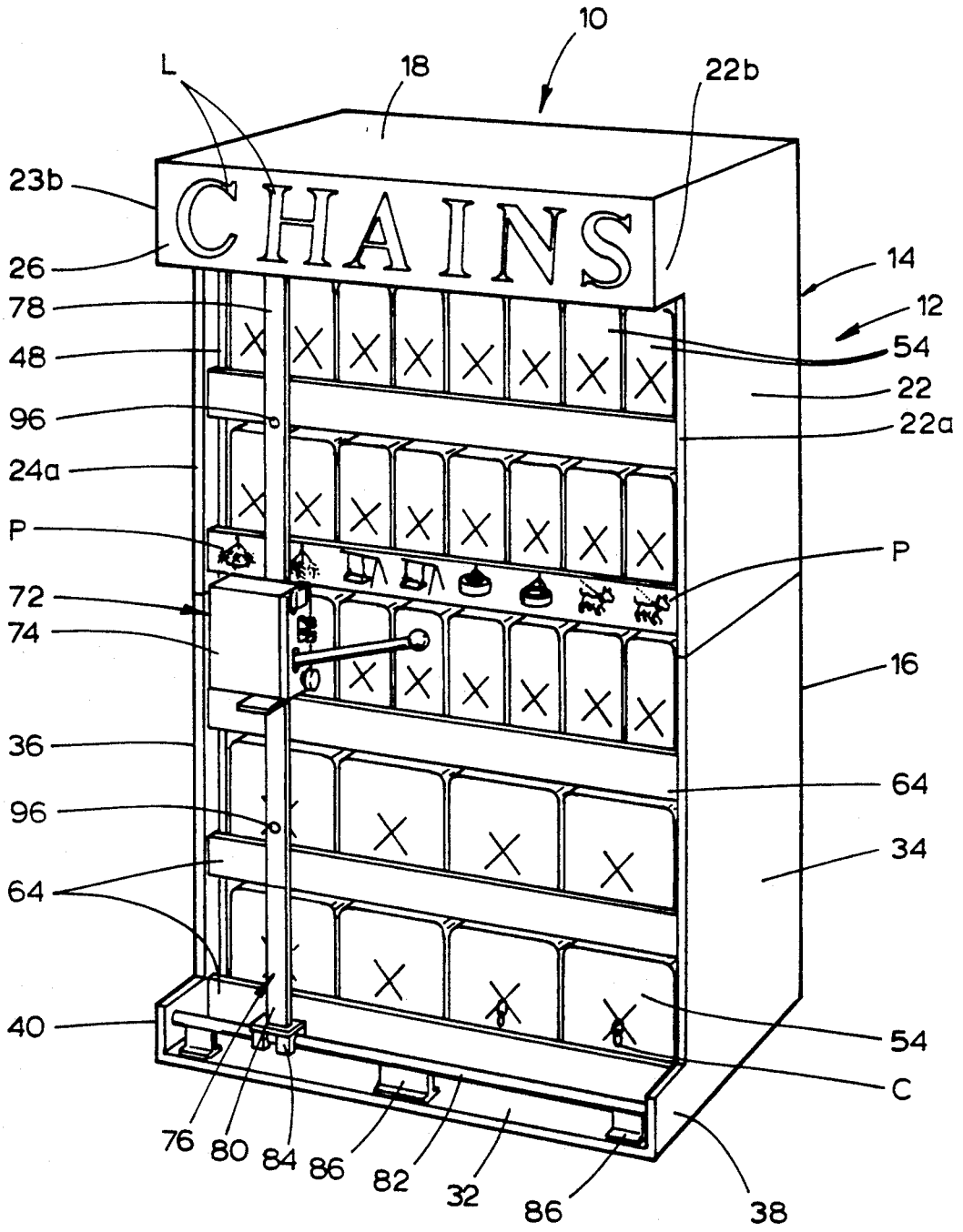
FIG. 1 is a front perspective view of a chain merchandising apparatus constructed in accordance with and embodying the present invention, showing schematically both unopened and opened boxes of chain supported therein.

Referring to the drawings, illustrated in FIGS. 1 through 6 and generally designated 10 is a chain merchandising apparatus embodying the present invention.

Figure 2:
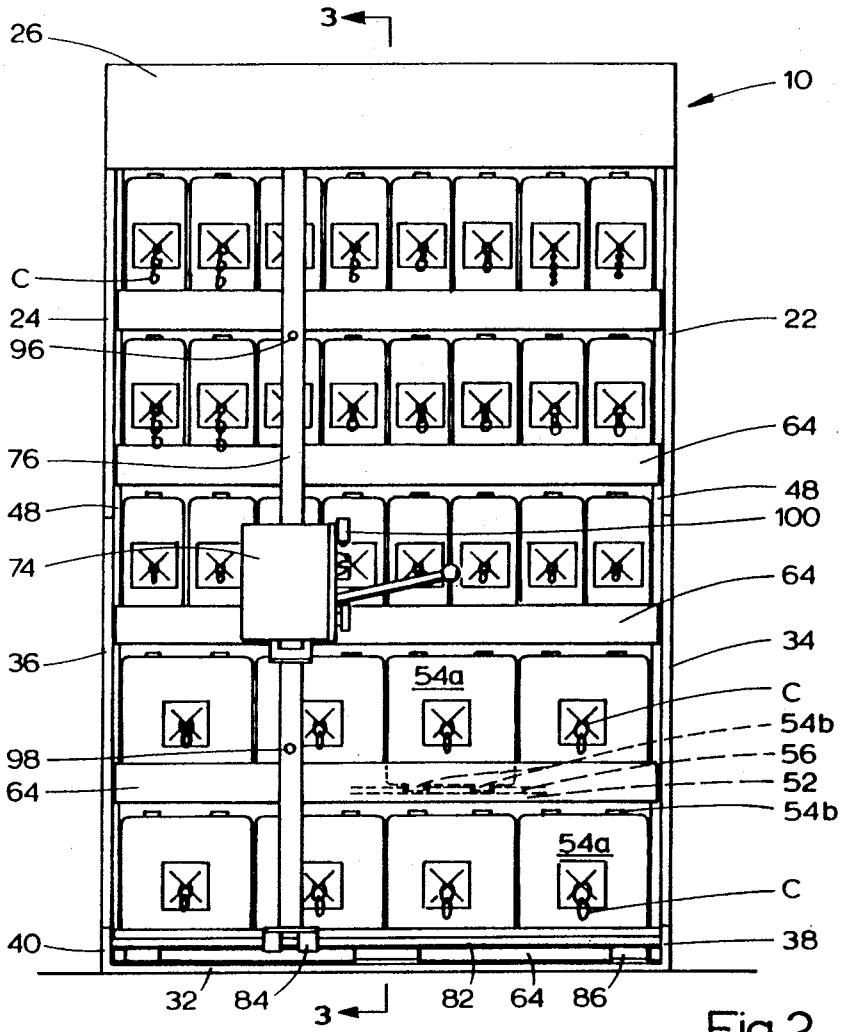
FIG. 2 is a front elevation view of the apparatus of FIG. 1 showing opened chain containers supported therein.
Figure 3:
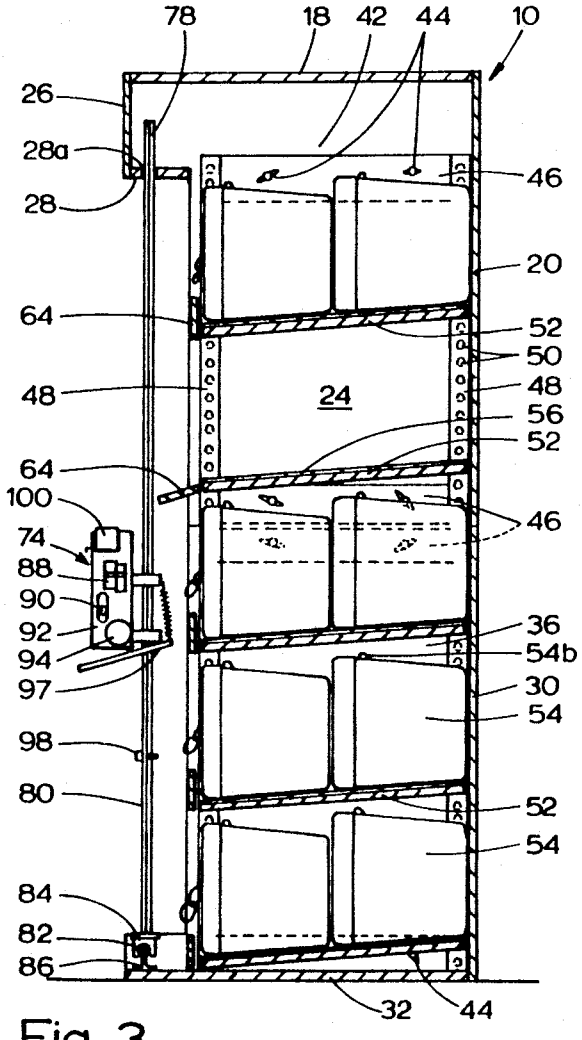
FIG. 3 is a right side section view taken on line 3—3 of FIG. 2.

FIGS. 1 through 3 illustrate that chain merchandising apparatus 10 includes a generally upright, box-shaped cabinet 12 having an upper portion 14 secured above a lower portion 16. Upper portion 14 includes a top panel 18 above a back panel 20 from which right and left side panels 22, 24, respectively, extend forwardly. Side panels 22, 23 terminate upwardly and forwardly in brow portions **22*b*, 23*b*, the latter connected by a front panel 26. Extending rearwardly from front panel 26 and parallel to and beneath top panel 18 is a narrow soffit panel 28 provided with a groove 28*a*** formed along a longitudinal axis therethrough, and discussed further hereafter.

Lower cabinet portion 16 is provided with a back panel 30 connected at right angles to a bottom panel 32 from which right and left side panels 34, 36, respectively extend upwardly, each of the latter being provided with a forwardly projecting foot portion, 38, 40, respectively. Bottom panel 32 extends forwardly to terminate coextensively with optional side panel foot portions 38, 40.

Abutting (or intersecting) panel portions of cabinet 12, e.g. 20, 24, are securely attached to each other by known fastening means (not shown), such as screwing, bolting, and if desired, reinforced by gluing. It is preferred that each of the above cabinet 12 panels be provided to the retailer in separated form with pre-drilled holes and screws, such as dry wall screws (not shown) to facilitate assembly by the retailer on site. However, cabinet 12 could be shipped assembled, pre-attached to frame 42, or in separated units consisting of upper 12 and lower 16 cabinet portions.

FIG. 3 illustrates that cabinet 12 is preferably detachably connected outwardly to a frame 42, for example via known carriage bolt and wing nut assemblies 44 which connect side panels 22, 24, 34, 36 to horizontal frame members 46, which later are in turn connected by conventional fastening means such as screws or bolts (not shown) to elongated vertical frame members 48. It is preferred that horizontal frame members 46 be fabricated from wood, such as one-by-six boards, and that vertical frame support members 48 be of metal, such as standard hollow vertical shelving support bars having upturned tab-like flanges or brackets 50 spaced at regular intervals along the length thereof.

For sufficient strength and economy vertical frame members 48 are four in number and attached at or near opposing ends of horizontal frame support members 46; the latter being preferably eight in total number, two per cabinet 12 side panel 22, 24, 34, 36 and connected at inside upper and lower ends thereof. So constructed, frame 42 provides a strong, substantially rigid and stable skeleton upon which a skin in the form of cabinet 12 is supported. Of course other combinations of materials and numbers and placement of frame members 46, 48 are also conceived which will function appropriately.

Figure 4:
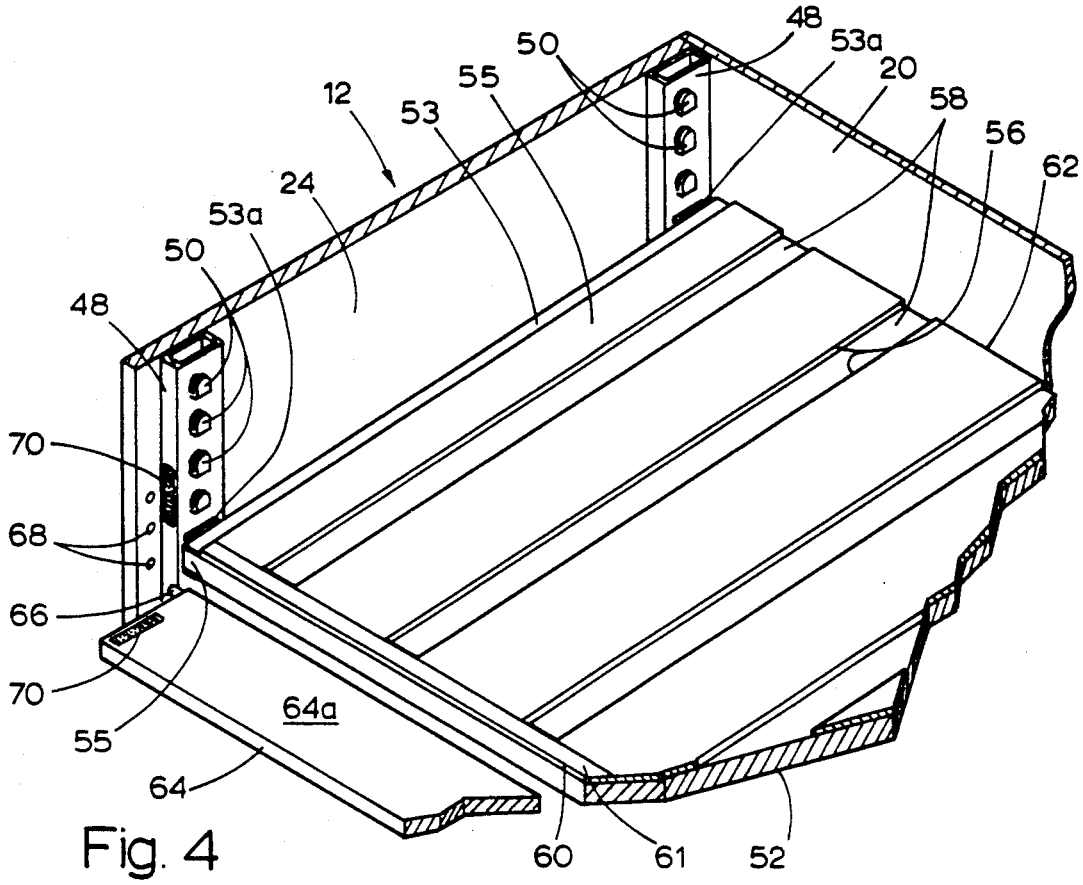
FIG. 4 is a partial breakaway view of the apparatus of FIG. 1 showing an empty open shelf with the front lip portion thereof in position for attachment thereto.

FIGS. 3 and 4 illustrate that supported by frame 42 within cabinet 12 are shelves 52 for supporting containers 54 of chain C. (Optionally, containers 54 may contain rope, hose, electrical wire or cable, not shown.) Shelves 52 are connected to vertical frame supports 48 by, for example, attachment of an elongated metal edge piece or channel-shaped sleeve 53 having a C-shaped cross section to each shelf end edge 55. Edge pieces 53 have preferably integral brackets **53*a*, as shown in FIG. 4, for connecting to upturned brackets 50 on vertical frame supports 48, as by merely hooking a bracket 53*a* over a preselected flange 50**.

Shelves 52 are connected to vertical frame supports 48 at whatever height is required, according to the height of containers 54 to be supported thereon. If a container 54 having angled walls is used, as shown in FIG. 3, it is preferred that a back edge 62 of shelf 52 is connected to brackets 50 so as to be slightly higher than a front shelf edge 60 as by a distance of one bracket 50 length. So attached, shelf 52 slopes very gently forward, facilitating loading and unloading of containers 54 and permitting containers 54 to face the user substantially vertically for enhanced viewability. Because of the inherent weight of chain C within each container 54 there is little risk of at least a filled container 54 sliding forward on such a slopedly positioned shelf 52. This is the case even though containers 54 are provided in sizes small enough to be readily lifted for shelf stocking purposes. However, other features discussed hereafter further inhibit containers 54 from inadvertently shifting from their intended placement on shelves 52.

FIG. 4 illustrates the preferred method of constructing shelves 52 so as to be formed of wood, fiber board, particle board, or the like, overlayered with a thin sheet or laminate 56 of masonite or other material so as to define grooves 58 formed parallel to one another and extending approximately from front edge 60 approximately to back edge 62 of each shelf 52. Laminated layer 56 may be applied in separate strips of material preferably pre-stapled to shelf 52 prior to providing same to a chain retailer. When the preferred chain container 54 having a face 54*a* and tabs 54*b* formed adjacent thereto on container 54 (FIGS. 2, 3 and 5) is used in combination with chain merchandising apparatus 10, tabs 54b may be appropriately sized to fit into grooves 58, for accurate positioning of the heavy, awkward containers of chain on shelves 52. (Shown in phantom in FIG. 2). Grooves 58 terminate forwardly at transverse strip 61 which is applied to shelf 52 at the front edge 60 thereof. So placed, transverse strip 61 acts as a stop to further prevent container 54 from unintentionally sliding forwardly from shelf 52 by catching tabs 54*b* on container 54.

Grooves 58 can also be otherwise formed, as by saw cuts partially penetrating shelves 52, although the latter construction of horizontal shelves 52 may be weaker. Of course, shelves 52 also function satisfactorily without the added feature of grooves 58.

Adjacent to front edge 60 of each shelf 52 is a horizontal slat 64, which appears lip-like in its upright normal display position, about four inches high at the front edge 60 of each corresponding shelf 52. Each slat 64 is preferably provided at opposed ends thereof with pegs 66 for insertion into holes 68 (FIG. 4) formed in side panels 22, 24, 34, 38 so as to permit slat 64 to be forwardly rotatable (shown in both closed and open positions in FIG. 3). Forward rotation of slat 64 may of course be accomplished by other means, for example by hinged attachment to shelf 52. The forward rotation of slat 64 to a flat, open position permits easy access to shelf 58 for loading and removal of containers 54 of chain C from a shelf 52.

FIG. 4 illustrates that slat 64 is maintained in a normally upright display position, for example by VELCRO strips 70 applied, as by gluing or other other known methods, to an upper inner surface 64*a* of slat 64 and to frame upright member 48. Other conventional releaseable attachment means, such as a hook and eye assembly (not shown) can also be used for this purpose and to provide greater securement of the upright position.

Figure 6:
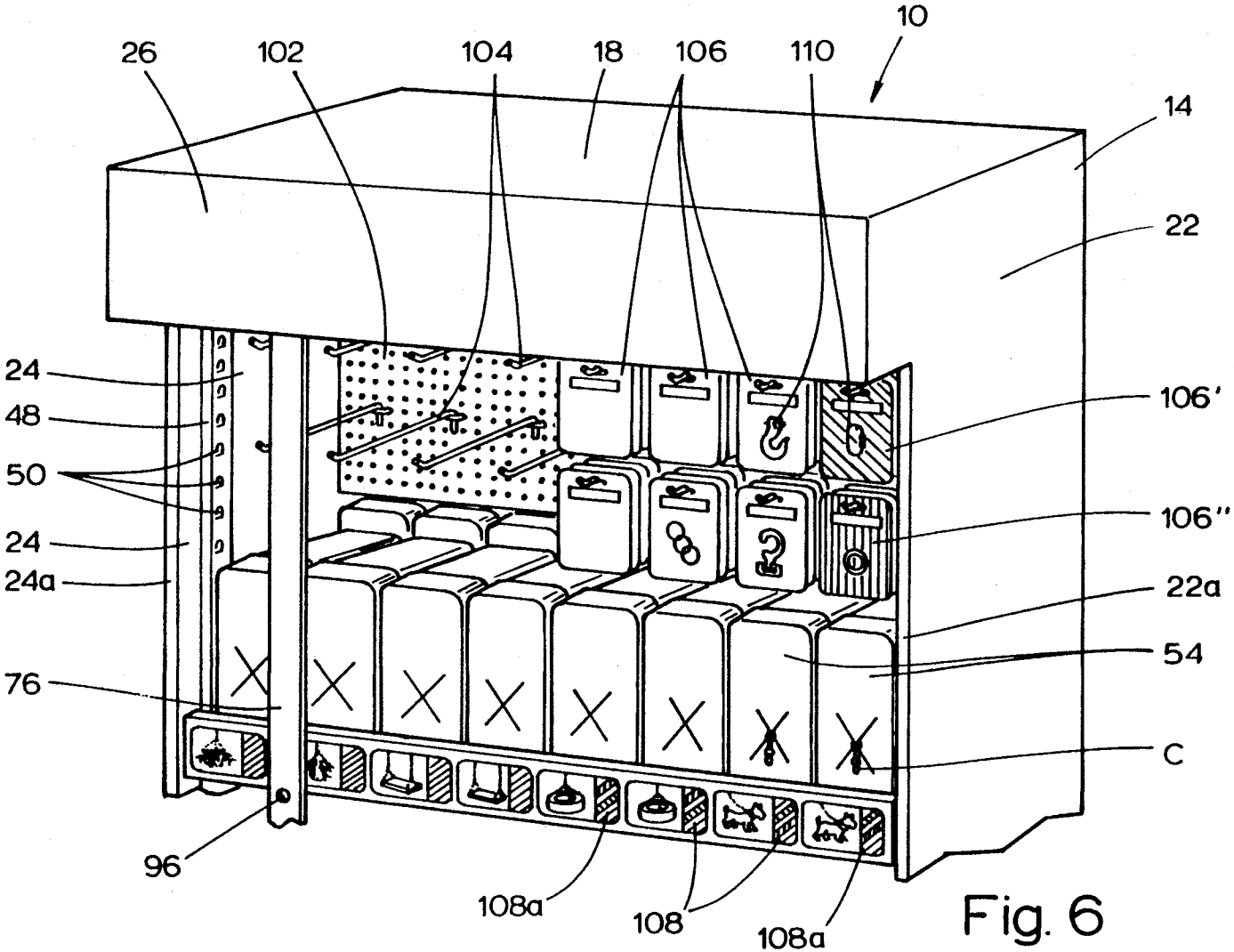
FIG. 6 is a partial breakaway view of the apparatus of FIG. 1 illustrating an adaptation thereof for simultaneous display of chain and chain accessories.

Front panel 26, side panels 22, 24, 34, 36 and shelf slat 64 all provide ideal surfaces for application of promotional or use information as by pictures P and letters L, shown as examples in FIGS. 1 and 6.

Figure 5:
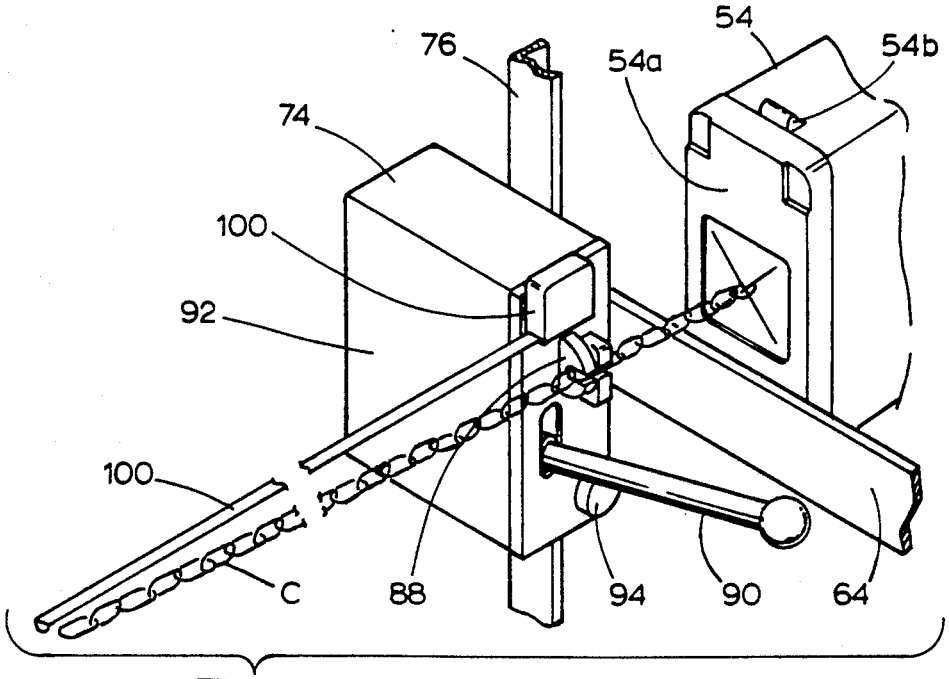
FIG. 5 is a partial breakaway view of the apparatus of FIG. 1 illustrating a chain in position for measurement and cutting.

Illustrated in FIGS. 1 through 3 and in more detail in FIG. 5 is an adjustable cutting assembly 72 for cutting chain C. Cutting assembly 72 includes a head portion, generally designated 74, mounted on a vertical support bar of angle iron 76 having an upper end 78 slidably housed within groove 28*a* of soffit 28 (FIG. 3) and a lower end 80 moveably coupled to a horizontal support bar 82 as, for example, by roller bearing couplings 84, the horizontal support bar 82 being secured to cabinet base panel 32 as by flanges 86 and screws (not shown).

Cutter head 74 is preferably of a type commercially available, for example from tool and die companies, and includes at least a blade assembly 88 and a handle 90 for activating the hydraulic cutting mechanism (not shown) within housing 92 (FIG. 3); which hydraulic mechanism operates blade assembly 88. Alternatively, blade assembly 88 could be operated by mechanical, electrical or pneumatic means (not shown). An adjustment knob 94 and spring and lever assembly 96 permit vertical positioning of head portion 74 up and down on support bar 76 so as to permit the user to place the blade assembly 88 as adjacently close as possible to the face 54*a* of a preselected container 54 of chain C. Horizontal adjustment is provided by simply rolling the entire cutting assembly 72 right or left along horizontal support bar 82.

FIG. 3 illustrates a safety feature which is provided in part by apertures 96 formed through vertical support bar 76 at several locations along the length thereof. Apertures 96 can be penetrated by a heavy bolt 98 which the user is directed to place in the closest aperture 96 beneath head portion 74 when cutting assembly 72 is in a preselected cutting position. So placed, bolt 98 will prevent head assembly 74 from dropping entirely to the bottom of assembly 72, if for any reason spring and lever assembly 97 should fail. This added safety feature is important in that head assembly 74 weighs approximately twenty-five pounds and could cause serious damage to a user's foot if it should inadvertently happen to strike same. Other braking or stopping mechanisms may also be adapted for use with the described adjustable cutting assembly 72 to prevent such potential free-fall hazards.

A further safety feature is anticipated, but not shown, in adapting cutting assembly 72 for automatic return of head 74 to a height of at least five feet, to reduce access by children. For example, a hydraulic mechanism could be incorporated into or replace vertical support bar 76. In use of the embodiment shown, the customer can be directed to return cutter head 74 to its highest position after use for safety.

As a convenience to the user, head assembly 74 is provided with a tape measure 100, preferably mounted directly above or adjacent to blade assembly 88 for the most accurate possible measurement and cutting of preselected chain C. Tape measure 100 could, alternatively, be substantially enclosed within cutting assembly head 74. It is contemplated that known electronic scanning means (not shown) also be mounted on head 74 for providing automatic pricing of a desired chain purchase as such chain is measured and cut. Known digital analog display functions and UPC coding features could also be incorporated.

FIG. 6 illustrates a further adaptation of chain merchandising apparatus 10, wherein a peg board 102 is placed within cabinet 12 (shown here as preferred, within upper portion 14, although other placement will suffice). Peg board 102 is fixed within cabinet 12 by conventional means, such as screwing or bolting, and may be situated adjacent back panel 20, but is preferred to be spaced somewhat forwardly thereof, for example so as to be approximately twelve inches from front edges 22*a*, 24*a* of panels 22, 24 and hung so as to be perpendicular to said walls 22, 24.

Suspended from peg board 102 are elongated hooks 104 for supporting chain accessory cards 106 which can be provided in various sizes for displaying chain accessories 110, such as those illustrated as examples in FIG. 6.

For the customer's convenience, it is preferred that accessory cards 106 be provided in various colors so as to be coded to match color bars 108 within color bar chain coding tags 108*a* (FIG. 6). Thus, by matching the background color of a card, for example cards 106' or 106'' which would be provided in different colors (preferably from four to seven industry standard P.M.S. shades) to a matching color bar 108 on a product identification tag 108*a*, the consumer can determine whether a particular accessory will be adaptable or correspond to the chain C in a container 54 supported directly above that particular tag 108*a* on a shelf 52. If the background color of the selected accessory card 106 is not shown in one of the bars 108 of the tag 108*a* associated with the desired chain C, that particular accessory can not be expected to function properly with the preselected chain C. For the retailer's convenience, product information tags 108*a* may be applied to apparatus 10 as what is commonly known in the industry as channel tags along the front of slat or lip 64 directly in front of the corresponding container supported on the superiorly adjacent shelf 52.

Although the above embodiment is preferred, numerous variations are contemplated which also are satisfactory. For example, cabinet 12 may be formed of one piece, and, if desired, the entire unit may be rigidly fixed together and shipped as a unit, rather than in pieces. Moreover, apparatus 10 could be provided with a generally horizontal, rather than upright structure; although the illustrated form requires less floor space per display area. Also, support frame 42 could be affixed outward of cabinet 12 and still function satisfactorily, but the internal frame 42 structure shown is preferred as providing a cleaner appearance. Furthermore, to decrease shipping weight, back cabinet panels 20, 30 could be replaced by a single metal cross-brace. Of course apparatus 10 can also be used with chain containers 54 shaped quite differently than those shown, such as five-gallon plastic buckets, with adequate success.

When constructed as shown in FIG. 1, and provided with the preferred overall dimensions of approximately four feet in width, six feet in height and two and one-half feet in depth, chain merchandising apparatus 10 easily accommodates thirty-two different sizes or styles of chain, cable or the like, with sufficient depth to permit storage of a second container of each type, as shown. The latter feature provides the merchandising advantages of facilitating shelf stocking and reducing the likelihood of "running out" of a particular type of chain in the midst of a particular customer's attempted purchase.

Accordingly it may be seen that the new chain merchandising apparatus provide many new and useful features to the art of chain retailing. Modern hardware stores require a neat, clean appearance, a safe, hazard free area and the ability to display a large selection of merchandise in an attractive, informative, safe manner. Chain merchandising apparatus 10 fulfills these needs while also being possessed of 1.) minimized shipping costs (from manufacturer to retailer; 2.) simplified, efficient assembly on site with little or no instruction; and 3.) ease of use by adult consumers, even those who may be non-English speaking or illiterate with little or no product wastage.

In view of the foregoing, it will be seen that the several objects of the invention are achieved and other advantages are attained.

Although the foregoing includes a description of the best mode contemplated for carrying out the invention, various modifications are contemplated.

As various modifications could be made in the apparatus herein described and illustrated without departing from the scope of the invention, it is intended that all matter contained in the foregoing description or shown in the accompanying drawings shall be interpreted as illustrative rather than limiting.

What is claimed is:

1. A chain merchandising apparatus; said apparatus comprising:

a. a frame, b. a cabinet secured to said frame, c. adjustable chain container support means mounted to said frame and located within said cabinet d. a plurality of chain containers; and e. chain cutting means movable on a set of bars, at least one of said bars being fixed to said apparatus so that said chain cutting means is selectively adjustable vertically and horizontally in relation to said apparatus for permitting a user to position said chain cutting means substantially adjacent to a preselected chain container on said chain container support means.

2. The chain merchandising apparatus of claim 1, wherein said cabinet is provided with an upper portion and a lower portion, and further wherein said chain container support means, said cabinet upper portion and said cabinet lower portion are detachably secured to said frame, and said chain cutting means is detachably moveably fixed to said apparatus, such that said apparatus may be disassembled and reassembled to facilitate shipping by a manufacturer thereof to a chain retailer and to further facilitate subsequent reassembly by such chain retailer.

3. The chain merchandising apparatus of claim 1, wherein said chain cutting means includes chain measuring means.

4. The chain merchandising apparatus of claim 1, and further wherein said apparatus is provided with pictorial information as to appropriate uses of chain drawn from containers supported on said apparatus.

5. The chain merchandising apparatus of claim 1, wherein said chain container support means includes chain container guide means for facilitating placement and movement of chain containers on said chain container support means.

6. The chain merchandising apparatus of claim 1, wherein said cabinet is provided with flat outer surfaces for providing a space on which to apply use and advertising information.

7. The chain merchandising apparatus of claim 1, wherein said chain container support means are adjustable shelves and said frame is provided with means for connecting said adjustable shelves at a preselected angle.

8. The chain merchandising apparatus of claim 1, wherein said chain container support means are at least one shelf having a front edge and said apparatus further comprises a horizontal slat positioned edgewise substantially adjacent to the front edge of each said shelf to thereby provide a lip to each said shelf.

9. The chain merchandising apparatus of claim 8, wherein each said horizontal slat is provided with means for selective forward rotation thereof to thereby facilitate loading and unloading of said shelves.

10. The chain merchandising apparatus of claim 8, wherein said apparatus is provided with means for selectively retaining each said slat in the edgewise, lip-providing position.

11. The chain merchandising apparatus of claim 1, wherein said apparatus is further provided with means for permitting simultaneous display of chain accessories to complement the chain being merchandised in said apparatus.

12. The chain merchandising apparatus of claim 11, and further wherein said apparatus and the chain accessories displayed thereon are provided with coded information to facilitate matching of the chain accessories to appropriate chain being merchandised on said apparatus.

13. The chain merchandising apparatus of claim 12, wherein the coded information is in the form of color coding.

14. The chain merchandising apparatus of claim 1, wherein said chain cutting means includes stop means to prevent uncontrolled vertical descent of said a portion of said cutting means.

15. The chain merchandising apparatus of claim 14, wherein said one of said bars is a vertical support bar extending between and terminating in opposed upper and lower ends, and a cutter head portion vertically moveably mounted on said vertical support bar.

16. The chain merchandising apparatus of claim 15, wherein another of said bars is a horizontal support bar secured transversely to said cabinet substantially adjacent to the support surface, and a soffit having a horizontal groove, and further wherein the upper end of said vertical support bar is slidably housed within the horizontal groove of said soffit and the lower end of said vertical support bar is moveably coupled to said horizontal support bar, to thereby permit selective horizontal adjustment of said chain cutting means on said apparatus.

17. The chain merchandising apparatus of claim 16, wherein said horizontal support bar is secured transversely to said cabinet substantially adjacent to the support surface, and the lower end of said vertical support bar is moveably coupled to said horizontal support bar by roller bearing couplings to facilitate selective horizontal adjustment of said chain cutting means on said apparatus for causing said chain cutting means to roll on said horizontal support bar.

18. The chain merchandising apparatus of claim 15, wherein said stop means to prevent uncontrolled vertical descent of a portion of said chain cutting means includes a series of apertures formed through said vertical support bar spacedly along the length thereof, and a bolt sized for placement into a preselected one of said series of apertures beneath the position of said cutter head to prevent uncontrolled vertical descent thereof.

19. A chain merchandising apparatus for use in combination with substantially box-shaped containers of chain, each said chain container having a face portion and at least one tab provided on said chain container adjacent to a lower edge of the face portion; wherein said chain merchandising apparatus comprises:

a. a frame, b. a cabinet secured to said frame, c. chain container support means connected to said frame and located within said cabinet for supporting a plurality chain containers; and d. chain cutting means movable on a set of bars, at least one of said bars being fixed to said apparatus so that said chain cutting means is selectively adjustable vertically and horizontally in relation to said apparatus; and wherein said chain support means comprises at least one shelf, each said shelf having an upper surface, a front edge and a back edge and being provided with grooves in said upper surface, said grooves extending substantially from said front edge to said back edge, said grooves further being spaced parallel to each other at a preselected distance so as to be adapted for receipt of the tabs provided on the substantially box-shaped chain containers, to thereby facilitate proper placement and movement of said chain containers on said shelves.

20. A chain merchandising apparatus; said apparatus comprising:

a. a frame, b. a cabinet secured to said frame, c. adjustable chain container support means mounted to said frame and located within said cabinet, d. a plurality of chain containers, and e. chain cutting means movably fixed to said apparatus so as to be selectively adjustable vertically and horizontally in relation thereto for permitting a user to position said chain cutting means substantially adjacent to a preselected chain container on said chain container support means, wherein said chain container support means is at least one shelf having a front edge and a horizontal slat positioned edgewise substantially adjacent to the front edge of each said shelf to thereby provide a lip to each said shelf, and further wherein each said horizontal slat is provided with means for selective forward rotation thereof to thereby facilitate loading and unloading of said shelves.

21. A chain merchandising apparatus; said apparatus comprising:

a. a frame, b. a cabinet secured to said frame, c. adjustable chain container support means mounted to said frame and located within said cabinet, d. a plurality of chain containers, and e. chain cutting means movably fixed to said apparatus so as to be selectively adjustable vertically and horizontally in relation thereto for permitting a user to position said chain cutting means substantially adjacent to a preselected chain container on said chain container support means, wherein said chain cutting means includes stop means to prevent uncontrolled vertical descent of said portion of said cutting means, and further wherein said chain cutting means includes a vertical support bar extending between and terminating in opposed upper and lower ends, and a cutter head portion vertically movably mounted on said vertical support bar.

22. The chain merchandising apparatus of claim 21, wherein said chain cutting means further includes horizontal support means secured transversely to said cabinet substantially adjacent to the support surface, and a soffit having a horizontal groove, and further wherein the upper end of said vertical support bar is slidably housed within the horizontal groove of said soffit and the lower end of said vertical support bar is movably coupled to said horizontal support means, to thereby permit selective horizontal adjustment of said chain cutting means on said apparatus.

23. The chain merchandising apparatus of claim 22, wherein said horizontal support means is a horizontal support bar secured transversely to said cabinet substantially adjacent to the support surface, and the lower end of said vertical support bar is movably coupled to said horizontal support bar by roller bearing couplings to facilitate selective horizontal adjustment of said chain cutting means on said apparatus by causing said chain cutting means to roll on said horizontal support bar.

24. The chain merchandising apparatus of claim 23, wherein said stop means to prevent uncontrolled vertical descent of a portion of said chain cutting means includes a series of apertures formed through said vertical support bar spacedly along the length thereof, and a bolt sized for placement into a preselected one of said series of apertures beneath the position of said cutter head to prevent uncontrolled vertical descent thereof.

* * * * *